United States Patent [19]

Kaiser

[11] 4,072,444

[45] Feb. 7, 1978

[54] AXIAL PISTON PUMPS

[75] Inventor: Georges J. Kaiser, Chenee, Belgium

[73] Assignee: Fabrique Nationale Herstal S.A., Herstal-lez-Liege, Belgium

[21] Appl. No.: 689,464

[22] Filed: May 24, 1976

[30] Foreign Application Priority Data

May 30, 1975 Belgium ..... 254376

[51] Int. Cl.[2] ..... F04B 1/14

[52] U.S. Cl. ..... 417/269

[58] Field of Search ..... 417/269, 270; 91/485

[56] References Cited

U.S. PATENT DOCUMENTS

| | | | |
|---|---|---|---|
| 3,498,227 | 3/1970 | Rita | 417/269 |
| 3,556,683 | 1/1971 | Schott et al. | 417/270 |
| 3,954,353 | 4/1976 | Mokasch | 417/269 |

FOREIGN PATENT DOCUMENTS

| | | | |
|---|---|---|---|
| 1,265,518 | 3/1972 | United Kingdom | 91/485 |

*Primary Examiner*—William L. Freeh

*Attorney, Agent, or Firm*—Browdy and Neimark

[57] ABSTRACT

The invention pertains to improvements to axial piston pumps of the type comprising, in combination, at least a plurality of annularilly distributed pistons housed in cylinders of a fixed block and in permanent contact with an inclined plate fixed to a pump shaft, an annular rotatable valve mounted on an eccentric fixed to said shaft, and means ensuring an axial hydrostatical compensation, characterized in that said means comprise, for each piston housing, a pocket provided in said block and an axially movable bobbin housed in said pocket, said pocket and bobbins facing an annular flange carried by the shaft of the pump.

3 Claims, 3 Drawing Figures

AXIAL PISTON PUMPS

BACKGROUND OF THE INVENTION

The present invention pertains to axial piston pumps of the type substantially comprising a plurality of pistons inserted into a fixed cylinder block and in contact with an inclined plate carried by the rotary shaft of the pump, an annular valve member, a pressure limitating device and a distribution chamber having two parallel faces with symmetrically disposed ports. These material elements are so conditioned that the position of the valve member may be modified with respect to that of said inclined plate, during the functioning of the pump, by means of a helical groove device. Such type of pump is well known and is for instance described in the US Pat. No. 3.074.345.

Such known pumps, although acceptable for low outputs, show serious limitations as to size and cannot work at high pressures, due to their very own characteristics.

It has indeed been established that the axial reaction on the inclined plate and transmitted to the shaft of the pump increases as the square of the dimensions of the pump whereas the longevity of the mechanical abutments and bearings decreases hyperbolically in function of the square of the load.

Above 30 to 33 cc/round and for actually accepted pressures from 300 to 400 bars, for instance, the longevity of the pump becomes inferior to the requirements of the actual market.

It has already been proposed to hydrostatically compensate the above-mentioned axial reactions by means of a by-pass circuitry establishing a communication between the two faces of aforesaid inclined plate. Such a solution, described for instance in the French Pat. No. 1.409.274, is not satisfactory in that it gives rise to pressure losses and to reso-nances, due to the unavoidable length of said by-pass ducts.

SUMMARY OF THE INVENTION

The object of the present invention is to avoid such shortcomings of the known pumps.

To this end, the present invention pertains to improvements to pumps of the considered type, whereby axial hydrostatic compensation means comprise, for each piston cylinder, a pocket provided in the cylinder block and an axially movable bobbinhoused in said pocket, said pockets and bobbins facing an annular flange carried by the shaft of the pump.

Simply by way of example, one embodiment of the invention is described in detail hereafter, reference being made to the appended drawings, wherein:

FIG. 1 is a longitudinal section of an improved pump according to the invention;

FIG. 2 schematically shows the axial compensation device according to the invention; and FIG. 3 shows, at a large scale, the part of FIG. 1 indicated by F3.

DETAILED DESCRIPTION OF THE PREFERRED EMBODIMENT

Figure 1:
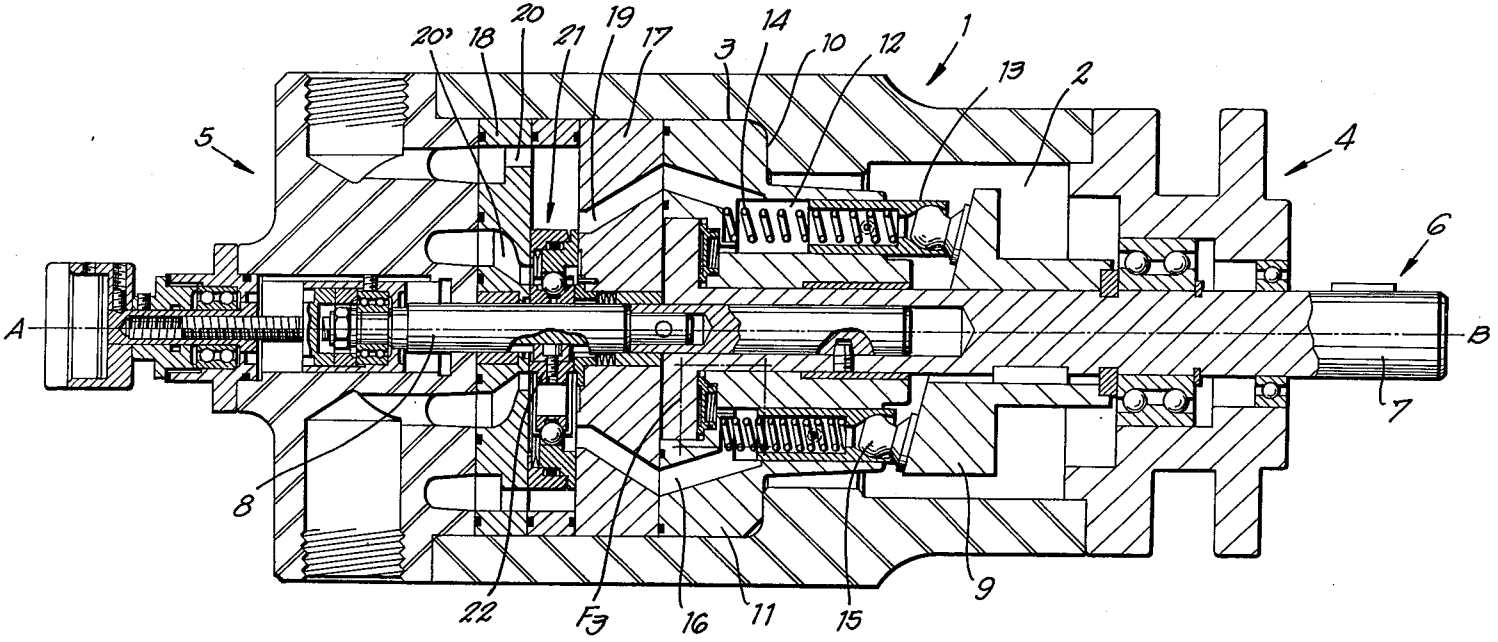

In this embodiment, the main components of a pump including the improvements according to the invention are the following : a housing 1 subdivided into two chambers 2–3 and closed at each end by a cover, respectively 4–5; a shaft 6 traversing said housing and constituted of two rotatable parts 7 and 8; an inclined plate 9 fixed to said part 7 within chamber 2; and a cylinder block 11 fixed to said housing 1 and against a shoulder 10 provided between said two chambers 2 and 3.

Cylinders 12 are provided in the block 11, said cylinders being circularly distributed at equal distance of the axis A–B of the shaft of the pump. Each cylinder houses a piston 13 permanently urged towards its withdrawn position by an individual spring 14. The contact between each piston 13 on the inclined face of plate 9 is ensured by a ball-and-socket device 15.

Said block 11 is provided with passages 16, each of which permanently communicating with one of said cylinders 12 as well as with the distribution device located in said chamber 3 of the housing.

This distribution device comprises ports 19, 20 and 20' and, between the fixed walls 17 and 18, a rotatable distributor or shutter 21 mounted on an excentric 22 fixed to the rotatable part 8 of the shaft 6 of the pump.

The essential characteristic of the improvements according to the invention consists in the fact that an axial hydrostatic compensation device is associated to each of the cylinders 12 of the fixed block 11.

Each of these devices is constituted by a pocket 23 provided in the block 11 and wherein a bobbin 24 is lodged. The latter is provided with a bore 25 facing said block and, in its opposite face, with a recess 26 surrounded by an annular face 27. A spring 28 is inserted into said bore 25 and bears against the bottom of pocket 23 to urge the bobbin 24 towards the face 29 of an annular flange 30 carried by the shaft part 7.

A calibrated passage 31 is provided in bobbin 24, establishing a communication between the bore 25 and the recess 26. A tightness ring 32 surrounds bobbin 24.

Figure 3:
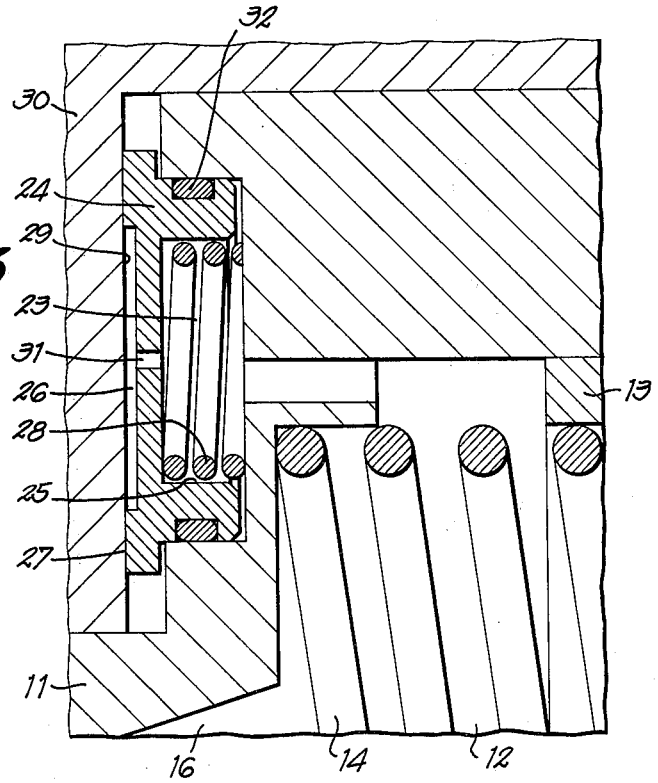

As clearly shown in FIG. 3, the dimensions of bobbin 24 are such that the latter may axially be displaced within the cup over a short distance.

When a cylinder 12 is under pressure, the fluid slightly separates face 27 from face 29, thus providing for an escape.

The surface 27, the recess 26, the passage 31 and the pocket 23 are respectively so dimensioned that, when the corresponding cylinder is under pressure, an equilibrium is obtained between, on the one hand, the product of the pressure by the surface of the bottom of pocket 23 and, on the other hand, the product of the pressure by the surface of the bottom of recess 26 to which is added the product of the surface of the annular face 27 by the integral of the pressure drop through said escape.

Figure 2:
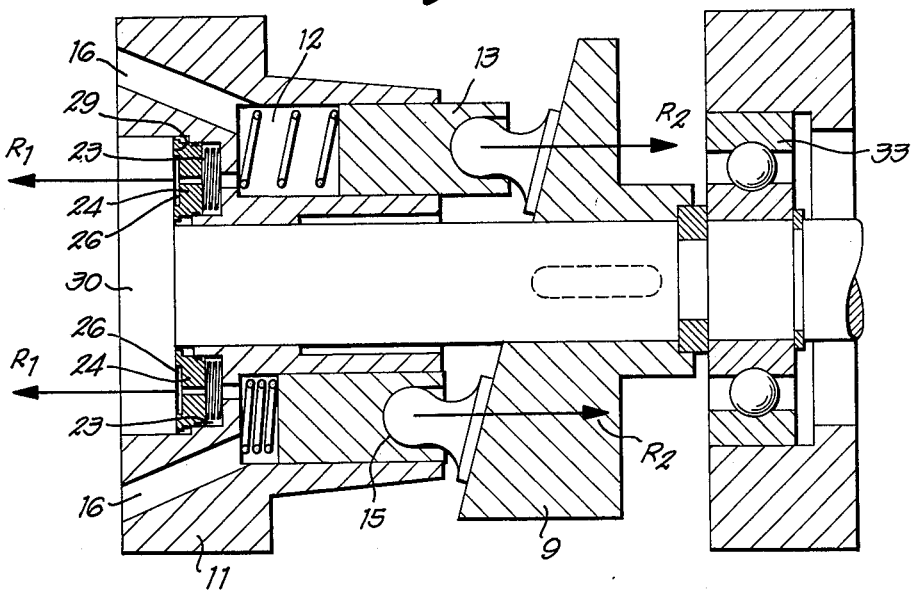

In this manner, resultants $R_1$ (FIG. 2) are obtained which balance the resultants $R_2$ acting on the inclined plate 9.

The axial load $\Sigma R_2$ acting on the shaft and on bearing 33 is thus compensated by the opposite load $\Sigma R_1$.

In practice, it is preferable to have $\Sigma R_1$ slightly inferior to $\Sigma R_2$ so as to prevent vibrations of the moving parts of the pump.

What I claim is:

1. In an axial piston pump which includes a shaft, at least a plurality of annularly distributed pistons housed in cylinders of a fixed block and in permanent contact with an inclined plate fixed to the pump shaft, an annular rotatable valve mounted on an eccentric fixed to said shaft, inlet and outlet means in the block for the cylinders and means for ensuring an axial hydrostatical compensation, the improvement wherein said means comprise, for each piston housing, a pocket provided in said block and an axially movable bobbin housed in said pocket; and additionally comprising a continuous annular flange carried by said shaft of the pump and forming with each said bobbin a respective balancing recess, said pockets and said bobbins facing said annular flange carried by said shaft of the pump with said bobbins when sliding being in contact with a continuous surface of said flange, said recesses being formed exclusively by said bobbins and said continuous annular flange.

2. An improved pump according to claim 1, wherein each said bobbin includes a bore towards the bottom of its associated said pocket and, on the opposite face, a respective one of said recesses surrounded by an annular face, and a respective calibrated passage provided between each respective one of said bores and each respective one of said recesses.

3. An improved pump according to claim 1, further comprising a respective spring in contact with each said bobbin, and wherein each said bobbin is urged by its associated said spring towards said annular flange.

* * * * *